US011191147B2

(12) United States Patent
Abramenko et al.

(10) Patent No.: US 11,191,147 B2
(45) Date of Patent: Nov. 30, 2021

(54) HIGH-BRIGHTNESS LASER-PUMPED PLASMA LIGHT SOURCE

(71) Applicants: RnD-ISAN, Ltd, Moscow (RU); ISTEQ B.V., Eindhoven (NL)

(72) Inventors: Dmitriy Borisovich Abramenko, Moscow (RU); Robert Rafilevich Gayasov, Moscow (RU); Denis Alexandrovich Glushkov, Nieuwegein (NL); Vladimir Mikhailovich Krivtsun, Moscow (RU); Aleksandr Andreevich Lash, Moscow (RU)

(73) Assignees: RnD-ISAN, Ltd, Moscow (RU); ISTEQ B.V., Eindhoven (NL)

( * ) Notice: Subject to any disclaimer, the term of this patent is extended or adjusted under 35 U.S.C. 154(b) by 0 days.

(21) Appl. No.: 17/180,063

(22) Filed: Feb. 19, 2021

(65) Prior Publication Data

US 2021/0282256 A1 Sep. 9, 2021

Related U.S. Application Data

(63) Continuation-in-part of application No. 16/986,424, filed on Aug. 6, 2020, now Pat. No. 10,964,523, which is a continuation-in-part of application No. 16/814,317, filed on Mar. 10, 2020, now Pat. No. 10,770,282.

(30) Foreign Application Priority Data

Mar. 5, 2020 (RU) ..... RU2020109782

(51) Int. Cl.
*H05H 1/24* (2006.01)

(52) U.S. Cl.
CPC ..... *H05H 1/24* (2013.01)

(58) Field of Classification Search
CPC ..... H01J 61/62; H01J 61/16; H01J 61/302; H01J 61/52
See application file for complete search history.

(56) References Cited

U.S. PATENT DOCUMENTS 5,379,315 A * 1/1995 Meinzer ..... H01S 3/0941 372/101
6,331,993 B1 * 12/2001 Brown ..... H01S 3/09415 372/55

* cited by examiner

*Primary Examiner* — Anne M Hines
(74) *Attorney, Agent, or Firm* — Nadya Reingand; Yan Hankin

(57) ABSTRACT

The light source contains a chamber with a region of radiating plasma sustained by a focused beam of a CW laser. The chamber consists of a tube, a bottom and a cap. The cap is arranged for filling the chamber with gas. The tube and bottom are made from an optically transparent material. The bottom is arranged for input into the chamber of the CW laser beam and pulsed laser beams used for the plasma ignition, while the tube is arranged for exit of the output beam of plasma radiation. Preferably shape of the tube is arranged for reducing aberrations which distort a path of rays of plasma radiation passing through the tube wall. The technical result consists in creating electrodeless high-brightness broadband light sources with the high spatial and power stability, and in providing an ability to collect plasma radiation in a spatial angle of more than 9 sr.

20 Claims, 7 Drawing Sheets

HIGH-BRIGHTNESS LASER-PUMPED PLASMA LIGHT SOURCE

CROSS-REFERENCE TO RELATED APPLICATIONS

This patent application is a Continuation-in-part of the U.S. patent application Ser. No. 16/986,424, filed on Aug. 6, 2020, which is in turn a Continuation-in-part of U.S. patent application Ser. No. 16/814,317, filed on 10 Mar. 2020, which claims priority to Russian patent application RU2020109782 filed Mar. 5, 2020, all of which are incorporated herein by reference in their entirety.

FIELD OF INVENTION

The present invention relates to high-brightness broadband light sources with continuous optical discharge.

BACKGROUND OF INVENTION

A stationary gas discharge sustained by laser radiation in pre-created relatively dense plasma is known as continuous optical discharge (COD). A COD, sustained by a focused beam of a continuous wave (CW) laser, is realized in various gases, in particular, in Xe at a high gas pressure of up to 200 atm (Carlhoff et al., "Continuous Optical Discharges at Very High Pressure," Physica 103C, 1981, pp. 439-447). COD-based light sources with a plasma temperature of about 20,000 K (Raizer Yu P "Optical discharges" Sov. Phys. Usp. 23789-806 (1980)) are among the highest brightness continuous light sources in a wide spectral range between about 0.1 μm and 1 μm.

In order to further increase brightness, pulsed lasers with a high pulse rate may be used as well, also in combination with CW laser with a power of not lower than the threshold value required to stably sustain the COD, for example, as described in RU Patent 2571433 published on 20 Dec. 2015.

Compared to arc lamps, COD-based light sources not only have a higher brightness, but also a longer lifetime, making them preferable for a variety of applications.

In the broadband light source known from U.S. Pat. No. 9,368,337 published on Jun. 14, 2016, COD plasma has an elongated shape along the laser beam axis, and plasma radiation is collected in the longitudinal direction, that provides for high brightness of the source.

However, a problem of laser radiation locking within the output beam of plasma radiation occurs in case of longitudinal collection of plasma radiation.

This drawback is overcome in the broadband light source known from U.S. Pat. No. 9,357,627 published on May 31, 2016, wherein radiation is collected in the directions other than the direction of laser beam propagation. In this case, by choosing the relative position of the chamber, laser beam (directed upwards along the chamber axis) and radiating plasma region (close to the upper part of the chamber), a higher spatial and power stability of the broadband source is achieved.

However, the shape and design of the chamber as well as COD sustaining conditions may not be optimal to achieve the highest possible brightness of the light source, in particular, due to optical aberrations introduced into the path of radiating plasma rays by the transparent walls of the chamber.

This drawback is partially overcome in the laser-pumped plasma light source known from U.S. Pat. No. 8,525,138 published on Mar. 9, 2013, where optical aberrations introduced into the path of radiating plasma rays by the transparent walls of the chamber are eliminated by modifying the shape of the optical collector, for example, an elliptical mirror.

However, modification of reflector shape is difficult to realize in practice for the most of laser-pumped plasma light sources.

These drawbacks are partially overcome in the light source known from U.S. Pat. No. 9,232,622 published on Jan. 5, 2016, where the CW laser beam is focused in the chamber using a system of mirrors with a high numerical aperture. Transparent wall of the chamber, through which the focused CW laser beam is introduced, has a variable thickness that eliminates optical aberrations in the system due to high pressure gas. This provides for sharp focusing of the CW laser beam, thus increasing brightness of the light source.

However, the light source has no provisions to eliminate optical aberrations introduced into the output beam of plasma radiation when it passes through the transparent walls of the chamber, reducing brightness of the light source. Besides, disadvantages caused by electrodes used for starting plasma ignition are inherent in the light source.

In general, laser-pumped plasma light sources are characterized with some of the following disadvantages:

- optical aberrations produced by the chamber with high pressure gas, which reduce brightness of the light source,
- imperfect shape of the chamber, in particular, due to the use of igniting electrodes restricting solid angle of plasma radiation output and increasing convective gas flows between high-temperature plasma regions and surrounding gas with a lower temperature, and
- high turbulence of convective gas flows in the chamber, reducing spatial and power stability of the light source.

SUMMARY

Accordingly, there is a need for creation of high-brightness and highly stable laser-pumped plasma light sources, which are free from at least some of the drawbacks mentioned above.

This need is met by features of the independent claim. The dependent claims describe embodiments of the invention.

According to an embodiment of the invention, there is provided a laser-pumped plasma light source, comprising: a chamber filled with high-pressure gas; a region of radiating plasma sustained in the chamber by a focused beam of a continuous wave (CW) laser; at least one output beam (which may also be termed useful beam) of plasma radiation exiting the chamber, and a means for plasma ignition.

The laser-pumped plasma light source is characterized in that the means for plasma ignition is a pulsed laser system generating at least one pulsed laser beam focused in the chamber; the chamber consists of a tube, a bottom and a cap; one end of the tube is hermetically connected to the bottom, and the other end is hermetically connected to the cap; the cap is arranged for filling the chamber with the gas; the tube and the bottom are made of optically transparent material; wherein the bottom is arranged for introducing the beam of the CW laser and each pulsed laser beam into the chamber, and the tube is arranged for exit of the output beam of plasma radiation from the chamber.

Besides the main functions said above, the elements of the proposed laser-pumped plasma light source may also include other functions providing wide capabilities of scaling, optimizing and controlling such output parameters of the light source as brightness, power capacity, spatial and power stability, and spectral range of broadband plasma radiation.

In the preferred embodiment of the invention the tube shape incorporates the function of reducing aberrations, which distort the path of rays of plasma radiation, when they pass through the tube walls.

If implemented according to the proposed embodiment, significant increase of spatial and power stability of the light source is achieved due to suppressing the turbulence of convective gas flows in the chamber, which is caused by a combination of the following reasons:

- use of laser ignition eliminating the presence of relatively cold electrodes near the high temperature plasma region;
- implementation of the possibility to optimize density, temperature and composition of gas and dimensions of the chamber;
- temperature stabilization of the chamber;
- use of the chamber geometry with vertical introduction of the laser beam; and
- use of an external bulb (which may also be termed shell) in some of the embodiments.

Electrodeless ignition of COD allows to significantly increase the solid angle of the output beam and the power in the output beam of plasma radiation. Geometry of the light source is also providing for highly efficient elimination of laser radiation in the beam of broadband plasma radiation.

The proposed light source provides for sharp focusing of the laser beam in the radiating plasma region. The proposed shape of the chamber reduces aberrations introduced into the output beam of plasma radiation when it exits the chamber. All of these, together with optimization of gas temperature and pressure, increase brightness of the light source.

The possibility to use chamber material, which allows for expending the variety of applied gas compositions, in particular, metal-halide additives when used with sapphire, is also realized.

Thus, the invention provides for a possibility to increase brightness, output power, and quality of radiation of the laser-pumped plasma light source, substantially improves its spatial and power stability, and expands options to control plasma radiation spectrum.

The technical result of the invention consists in creation of broadband light sources with highest possible brightness and stability, also characterized with elimination of aberrations both when introducing the pumping laser radiation and outputting the broadband plasma radiation from the chamber.

The advantages and features of the present invention will become more apparent from the following non-limiting description of exemplary embodiments thereof, given by way of example with reference to the accompanying drawings.

BRIEF DESCRIPTION OF THE DRAWINGS

Embodiments of the invention are explained with reference to the drawings, wherein.

In the drawings, the matching elements of the device have the same reference numbers.

These drawings do not cover and, moreover, do not limit the entire scope of embodiments of this technical solution, but are only illustrative examples of particular cases of implementation thereof.

DETAILED DESCRIPTION OF THE PREFERRED EMBODIMENTS

This description is provided to illustrate how the invention may be implemented and in no way to demonstrate the scope of this invention.

Figure 1:
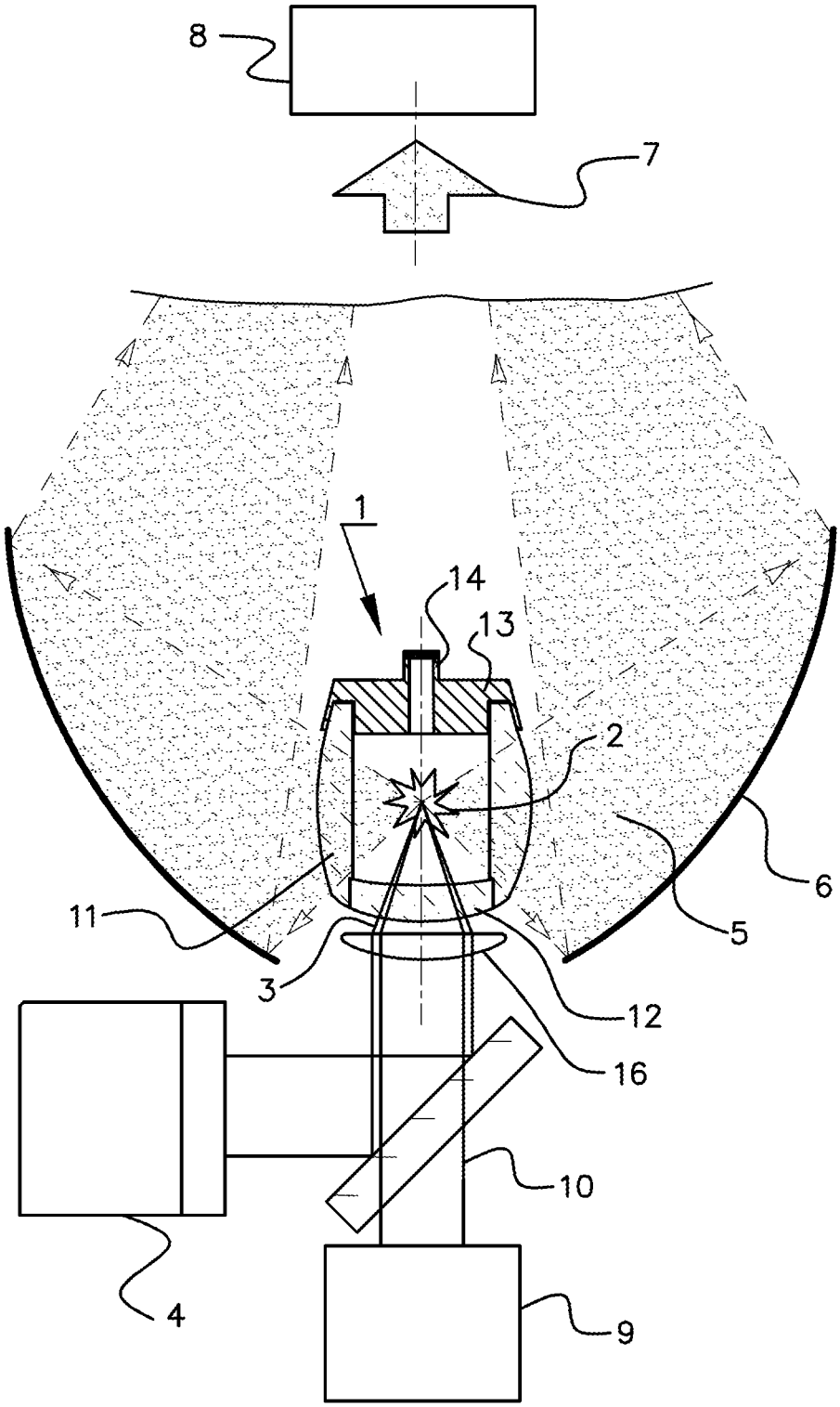
FIG. 1—Schematic diagram of laser-pumped plasma light source in accordance with an embodiment, FIG. 2A and FIG. 2B.—Illustration of reduction of the light source brightness due to aberrations caused by the tube wall (FIG. 2A) and the mechanism of their suppression by means of shaping the external surface of the tube of the chamber (FIG. 2B), FIG. 3A and FIG. 3B—Schematic diagram of the focusing optical system (FIG. 3A) and calculated laser power distribution in the focal spot (FIG. 3B), FIG. 4, FIG. 5. Schematic diagram of the light source in accordance with the embodiments, FIG. 6. Schematic view of the light source with the three-channel output of useful plasma radiation, FIG. 7. Schematic diagram of the chamber of the light source, equipped with the external bulb.

According to the example of invention embodiment shown in FIG. 1, the laser-pumped plasma light source comprises chamber 1 filled with high-pressure gas, typically higher than 10 atm. Chamber 1 contains radiating plasma region 2 sustained by focused beam 3 of CW laser 4. At least one output beam 5 of plasma radiation, directed to an optical collector 6 and intended for subsequent use, exits chamber 1. The optical collector comprising, according to an embodiment of the invention, a parabolic mirror 6 forms plasma radiation beam 7, transmitted, for example, via an optical fiber or a system of mirrors to optical consumer system 8, which uses broadband plasma radiation.

The light source is characterized in that the means for plasma ignition is a pulsed laser system 9 generating as least one pulsed laser beam 10 focused in chamber 1, namely into the region intended for sustaining radiating plasma 2.

According to the invention, chamber 1 consists of a tube 11, a bottom 12 and a cap 13. One end of tube 11 is hermetically connected to the bottom 12, and the other end of tube 11 is hermetically connected to cap 13. Cap 13 is arranged for filling the chamber with gas, for example, through a tube 14 sealed off after the filling. Tube 11 and bottom 12 of the chamber are made from optically transparent material.

The bottom is arranged for introducing focused beam 3 of CW laser 4 into the chamber, as well as each one of pulsed laser beams 10 used for plasma ignition.

Tube 11 of the chamber, made of optically transparent material, is intended to output beam 5 of plasma radiation from chamber 1.

According to embodiments of the invention, a possibility to optimize the design of the chamber and operating modes of the light source is realized in order to increase brightness as well as its spatial stability and output power stability.

In output beam 5 of plasma radiation, the path of rays non-perpendicular to the internal and/or external surface of the tube is distorted when they pass through the wall of tube 11. As a result of these aberrations, brightness of the light source may significantly decrease.

In order to increase brightness of the light source, in the preferred embodiments of the invention, the shape of tube 11 is arranged for reducing aberrations, which distort the path of rays of plasma radiation when they pass through the tube walls. Complete elimination of aberrations is achieved when the parts of external and internal surfaces of the chamber, through which output beam 5 of plasma radiation exits the chamber, are the parts of two concentric spheres that may be difficult to implement.

In particular, to simplify the chamber fabrication process, preferably, a part of the internal surface of tube 11 is cylinder-shaped, as shown in FIG. 1.

Substantial reduction of aberrations is achieved in the embodiments characterized in that a part of tube 11 has an axis of symmetry, a center of symmetry aligned with radiating plasma region 2 and is barrel-shaped or toroid-shaped in the external surface, FIG. 1. In these embodiments of the invention, aberrations are reduced by using a relatively simple and easy-to-fabricate chamber 1.

Figure 2A:
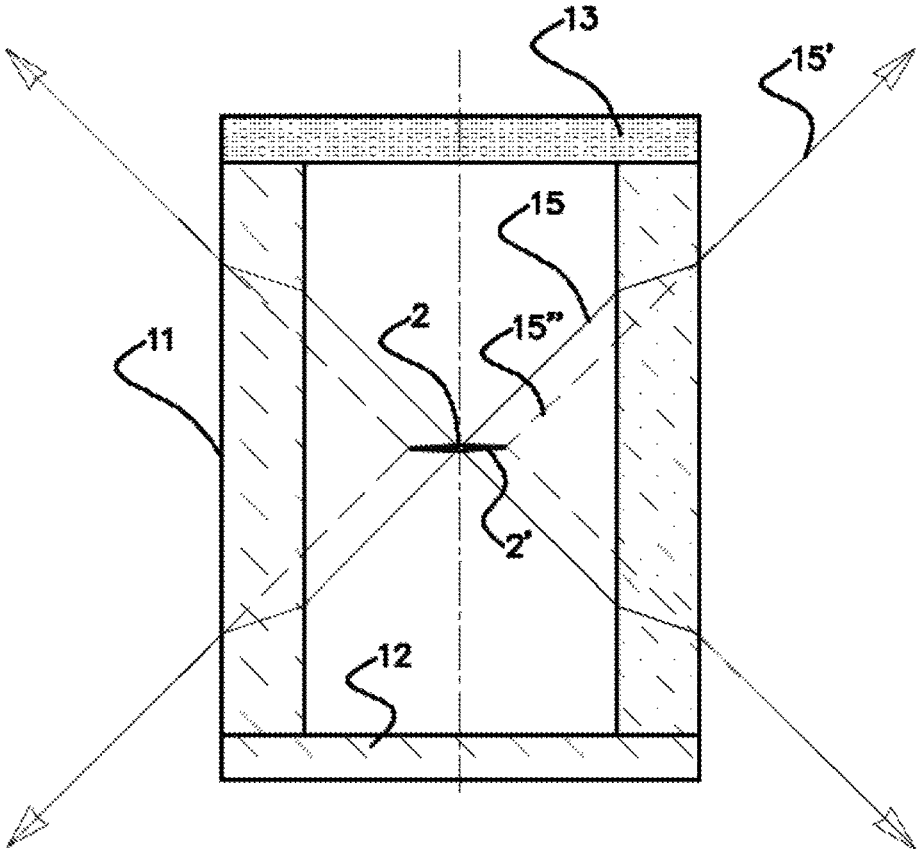

FIG. 2A shows schematic diagram of a homocentric beam of optical rays from quasi-zero-dimensional radiating plasma region 2, passing through the cylindrical walls of the tube 11. The output beam opening angle just near radiating plasma region 2 is designated with optical rays 15. At interfaces, i.e. on surfaces of tube 11 of the chamber, the rays are refracted in accordance with Snell's refraction law:

$$n_1 \sin \theta_1 = n_2 \sin \theta_2 \quad (1)$$

where $n_1$, $n_2$—refractive indices of the medium, $\theta_1$, $\theta_2$—angles measured from the normal of the boundary.

Let us designate rays 15 passed through transparent tube 11 of chamber as rays 15', which are displaced from rays 15 and parallel to it, as shown in FIG. 2A. The bigger an angle to the normal, the grater the displacement is. As a result of passing the cylinder-shaped tube of the chamber, the output beam becomes astigmatic, i.e. the rays passed through the chamber wall cease to converge to a point. From the side of rays 15' exited the chamber, which extension is shown with dotted lines 15", the quasi-zero-dimensional source of radiation (imaginary center of rays 15') takes on a disk shape 2' (FIG. 2A) due to aberrations, and as a result, the surface area visible from the outside of the chamber significantly increases. Thus, when using a simple cylindrical tube of the chamber, aberrations substantially reduce brightness of the light source in the directions other than normal to the tube surface.

Figure 2B:
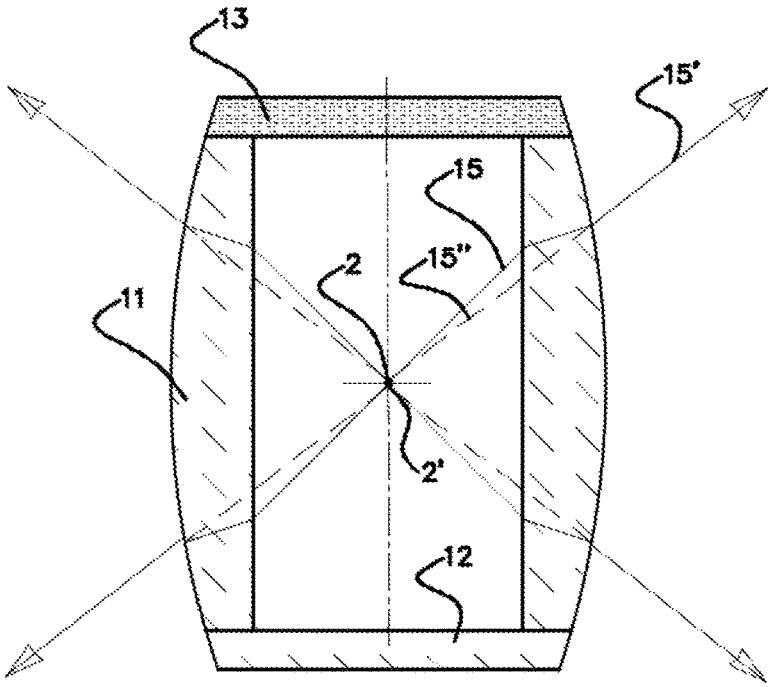

If the external surface of tube 11 is implemented according to the invention, FIG. 2B, rays 15', after passing through the tube walls, are not only displaced from rays 15, but also inclined to the propagation direction of rays 15 near radiating plasma region 2. As a result, a beam with opening angle designated with rays 15' remains almost homocentric, and radiating plasma region 2' visible from the side of rays 15', which have passed the tube of the chamber, remains quasi-zero-dimensional. This provides evidence of efficient elimination of the aberrations, which may significantly reduce brightness of the light source in the tube configurations shown as an example in FIG. 2A.

In general, external surface of the tube should be shaped to eliminate chromatic and spherical aberrations.

According to the calculations made, for the radiating plasma region of elliptical shape with dimensions 0.1×0.2 mm and the tube of the chamber with cylinder-shaped internal surface, for example, with a radius of approximately 3 mm, and toroid-shaped external surface of optimized configuration, for example, with a curvature radius close to 20 mm, only 11% of the light source brightness reduction is possible within a rather wide solid angle compared to the spherical chamber.

The laser-pumped plasma light source operates as follow. Focused beam 3 of CW laser 4 is directed in chamber 1 comprising tube 11, the ends of which are hermetically connected to bottom 12 and cap 13 of chamber, FIG. 1. Cap 13 is arranged for filling the chamber with high-pressure gas, more than 10 atm. Xenon, other inert gases and their mixtures may be used for filling, including those containing metal vapors, for example, mercury, or various gas mixtures, including those containing halogens. Pulsed laser system generates at least one pulsed laser beam 10 focused into region of the chamber intended for sustaining radiating plasma 2. The beams of CW laser 4 and pulsed laser system 9 are introduced into chamber 1 through a focusing optical element 16 and bottom 12 of the chamber. Pulsed laser system 9 provides for the optical breakdown and generation of initial plasma with a density higher than the threshold plasma density of the continuous optical discharge having a value in the order of $10^{18}$ electrons/cm$^3$. Concentration and volume of the initial plasma are sufficient to stationary sustain the COD with focused beam 3 of CW laser 4 of a relatively low power, not exceeding 300 W. In stationary mode, high-brightness broadband radiation is output from radiating plasma region 2 of the COD by at least one output beam 5 of plasma radiation intended for subsequent use. Beam 5 of plasma radiation exits the chamber through tube 11, external surface of which is shaped to reduce aberrations that distort the path of rays of plasma radiation when they pass through the tube wall.

FIG. 1 shows that according to the present invention the tube 11 of the chamber, except for the end parts used to seal the chamber, is intended for exit of beam 5 of plasma radiation from the chamber in all azimuths. This means that in azimuth plane passing through the region of radiating plasma 2 perpendicular to the axis of beam 3 of the CW laser, the output beam of plasma radiation exits the chamber in all azimuths from 0° to 360°. Preferably, the opening angle (in the plane of the drawing in FIG. 1) of beam 5 is not less than 90°. This means that the beam 5 of useful plasma radiation exits from chamber 1 to optical collector 6 in a solid angle, which is not less than 9 sr or more than 70% of the full solid angle.

In order to provide high brightness of the laser-pumped plasma light source, a sharp focusing of beam 3 of the CW laser is required. This, in its turn, requires to minimize aberrations, in particular, spherical aberration of the focusing optical system. According to the present invention, beam 3 of CW laser 4 is focused in chamber 1 by means of an optical system comprising bottom 12 of the chamber and focusing optical element 16. A mirror, for example, off-axis parabolic mirror or, preferably, a lens 16 due to its small size, as shown in FIG. 1, may be used as a focusing element.

In order to simplify the design of the chamber, its bottom 12 is, preferably, made in the form of an optical element, quite a simple to make it commercially available, for example, in the form of a plate with spherical and/or flat surfaces. According to the present invention, the optical element 16 located outside the chamber and having more complicated shape than the bottom of the chamber incorporates the function of minimizing total aberrations of the optical system comprising optical element 16 itself and the bottom 12 of chamber.

Figure 3A:
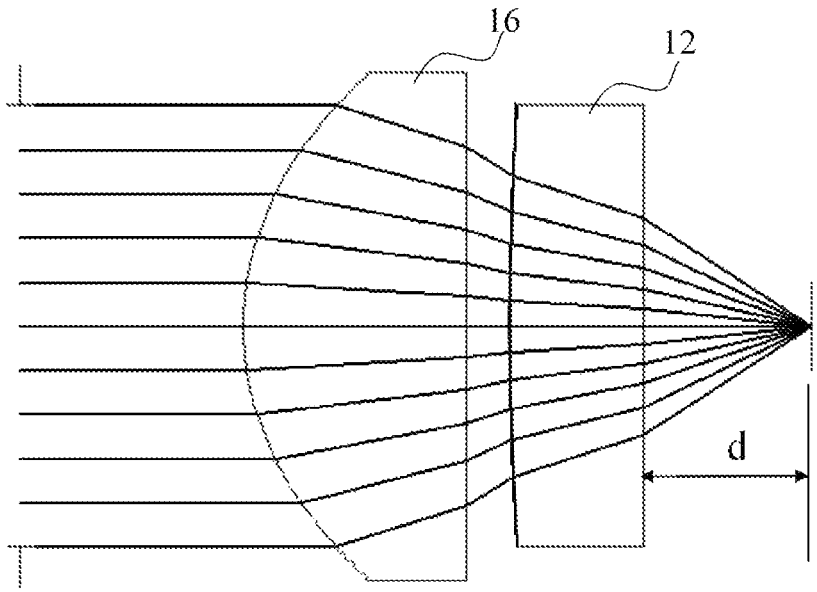

For illustration, FIG. 3A shows a schematic diagram of the optical system intended for focusing the laser beam, which comprises bottom 12 of the chamber in the form of a flat-convex spherical lens and focusing optical element 16 in the form of a flat-convex aspherical lens. Preferably, the bottom of the chamber and the aspherical lens are made of different materials, that allows for optimizing characteristics of the optical system of these two elements more flexibly.

Figure 3B:
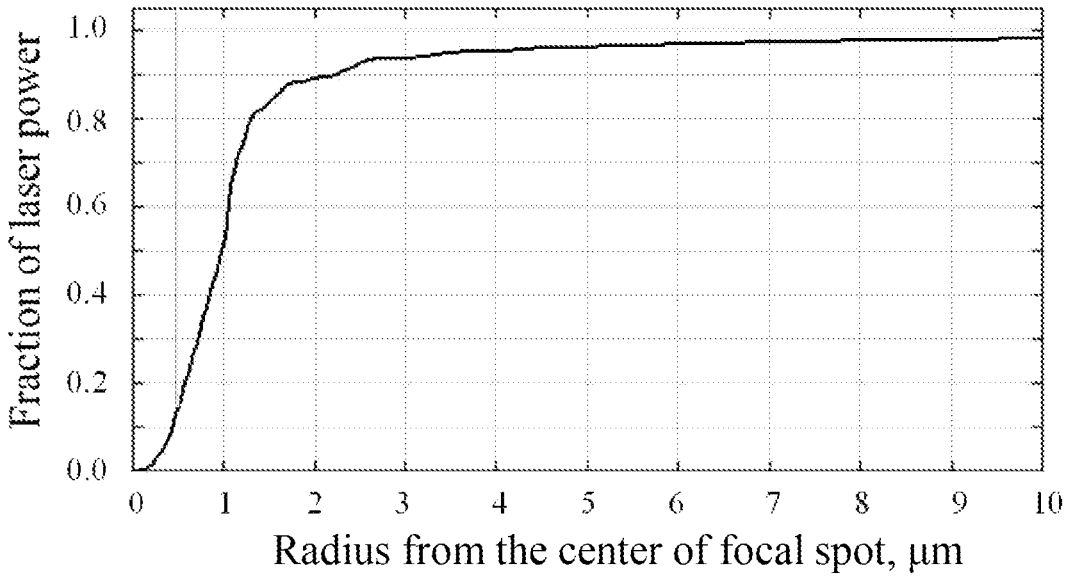

The calculation results in FIG. 3B show that optical system realized in accordance with the present invention, in general, allows for focusing about 90% of the laser beam power in a spatial region with a radius of as small as 2.5 μm at a distance d of about 4 mm from the bottom 12 of the chamber.

However, the present invention admits other embodiments, in which the sharp focusing of beam 3 of the CW laser is provided by only one focusing lens, in particular, aspherical, which is bottom 12 the chamber.

Figure 4:
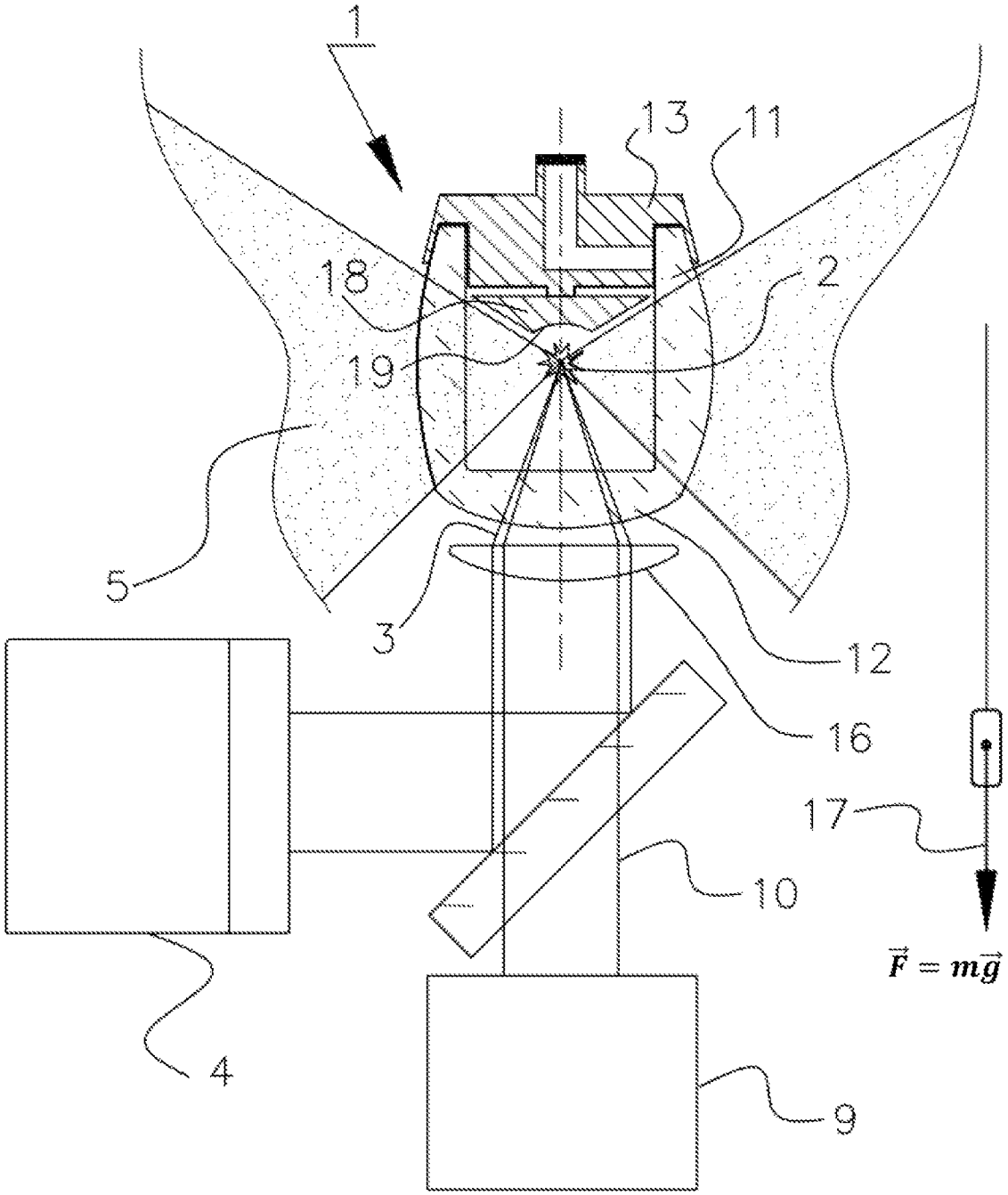

The preferred embodiment of the present invention is characterized in that the axis of focused beam 3 of the CW laser is directed vertically upwards, i.e. against the force of gravity 17, FIG. 4, or close to the vertical. If implemented according to the proposed embodiment, the highest radiation power stability of the laser-pumped plasma light source is achieved. This is associated with the fact that radiating plasma region 2 is typically displaced from the focus towards focused beam 3 of the CW laser up to that cross-section of the focused laser beam where the intensity of focused beam 3 of the CW laser is still high enough to sustain radiating plasma region 2. When focused laser beam 3 of the CW laser is directed from the bottom upwards, radiating plasma region 2, containing the highest-temperature and low mass density plasma, tends to float under the action of the buoyant force. Radiating plasma region 2, when rising, ends up in the location closest to the focus where the cross-section of focused beam 3 of the CW laser is smaller, and the laser radiation intensity is higher. On the one hand, this increases brightness of plasma radiation, and on the other hand, it equalizes the forces acting on the radiating plasma region, that ensures high stability of radiation power of the high-brightness laser-pumped plasma light source.

To realize these positive effects, preferably, chamber 1 is axially symmetric, and the axis of focused beam 3 of the CW laser is aligned with the axis of symmetry of the chamber.

The turbulence of convective flows in the chamber is suppressed, in particular, by means of reducing its dimensions. This is easily realizable in the proposed design of the laser-pumped plasma light source, the embodiments of which are characterized in that the radius (or more correctly radius of curvature) of the internal cylinder-shaped surface of the tube is less than 5 mm, preferably, not exceeding 3 mm.

Stability of output parameters of the laser-pumped plasma light source is also influenced by a value of pulse acquired under the action of the buoyant force by the gas heated in radiating plasma region 2. The closer the region of plasma radiation 5 to the upper wall of the chamber, the smaller both the pulse acquired by the gas and the turbulence of the convective flows. In this regard, to increase stability of output characteristics of the light source in the embodiment shown in FIG. 4, a part or portion 18 of the cap 13 is located close to the radiating plasma region 2 at a distance less than 3 mm, minimum possible in order to avoid sensible negative effect on the light source lifetime.

In this regard, part 18 of the cap may be made of a refractory material such as tungsten, molybdenum or alloys based thereof.

Part 18 of the cap may also be made with the function of reflecting and focusing in radiating plasma region 2 of laser radiation passed through the radiating plasma region, and broadband plasma radiation. This increases the plasma temperature, and brightness and efficiency of the light source. According to this embodiment of the invention, shown in FIG. 4, part 18 of the cap is made in the form of a concave spherical mirror 19 with a center in the radiating plasma region 2.

In the embodiments of the invention, tube 11 and bottom 12 of the chamber may be made as an integral unit from a single piece of material, FIG. 4.

In other embodiments, tube 11 and bottom 12 of the chamber are sealed using refractory glass cement ensuring long lifetime of the light source at high temperatures, above 900 K.

The end parts of tube 11 are used to seal the chamber. In this case, cap 13 and tube 11 of the chamber are sealed by means of brazing with the use of a high-temperature braze, preferably, with a melting point not less than 900 K. Before brazing, the end part of the tube 11 of the chamber is metalized.

The cap of the chamber may consist of several pieces or parts made of either metal or ceramics.

Preferably, tube 11 and bottom 12 of the chamber are made of a material from the group comprising sapphire, leuco-sapphire, fused and crystalline quartz, which have the most distinguished optical, physical, chemical and mechanical properties.

Figure 5:
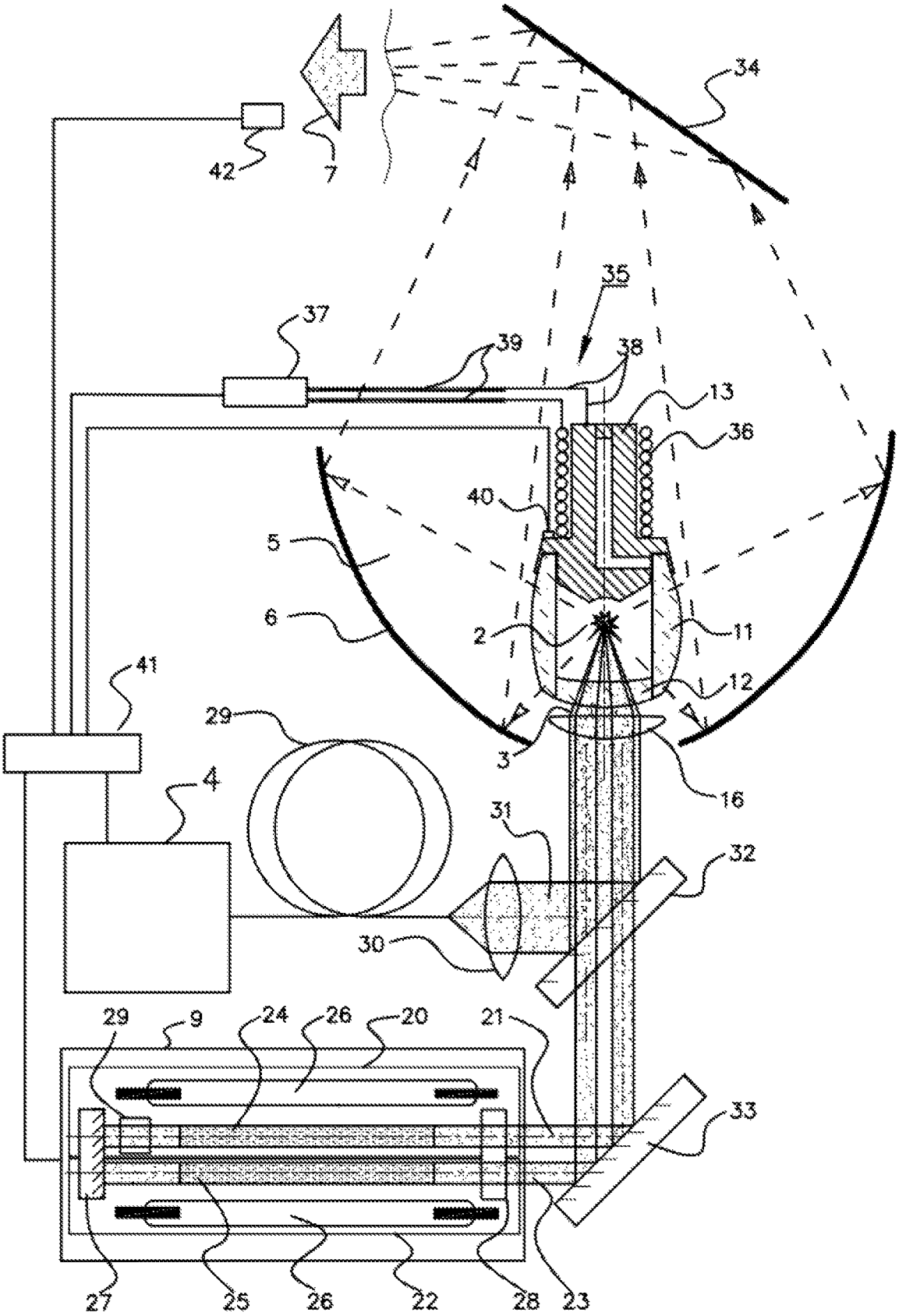

A detailed example of the light source according to the present invention is shown as a schematic diagram in FIG. 5. In this embodiment of the invention, for starting plasma ignition, a solid-state laser system is used, comprising first laser 20 to generate first laser beam 21 in the Q-switching mode and second laser 22 to generate second laser beam 23 in the free-running mode. The pulsed lasers with active elements 24, 25 are equipped with optical pumping sources, for example, in the form of flash lamps 26 and, preferably, have common mirrors 27, 28 of the cavity. First laser 20 is equipped with a Q-switch 29.

Two pulsed laser beams 21, 23 are focused in the chamber, in the region intended to sustain radiating plasma 2, FIG. 4. First pulsed laser beam 21 is intended for starting plasma ignition or optical breakdown. Second pulsed laser beam 23 in intended to create plasma, the volume and density of which are high enough for stationary plasma sustenance by the focused beam 3 of the CW laser.

Preferably, a high-efficiency near-infrared diode laser with the output to an optical fiber 29 is used as a CW laser 4. At the exit of optical fiber 29, the expanding laser beam is directed to collimator 30, for example, in the form of a collecting lens. After collimator 30, expanded parallel beam 31 of the CW laser is directed to focusing optical element 16, for example, in the form of an aspherical collecting lens. The focusing optical system comprising optical element 16 and bottom 12 of the chamber ensures sharp focusing of beam 3 of CW laser 4 required to achieve high brightness of the light source.

Preferably, the wavelength $\lambda_{CW}$ of the CW laser is different from wavelengths $\lambda_1$, $\lambda_2$ of first and second pulsed laser beams 21, 23. For example, a wavelength of CW laser may be $\lambda_{CW}$=0.808 μm or 0.976 μm, and the pulsed lasers may have wavelengths $\lambda_1=\lambda_2$=1.064 μm. This allows using dichroic mirror 32 to introduce laser beam 31 of the CW laser and beams 21, 23 of the pulsed lasers. To transfer beams 21, 23 of the pulsed laser beams, a deflecting mirror 33, FIG. 5, may also be used.

Optical collector 6, to which beam 5 of plasma radiation is directed, forms a beam 7 of plasma radiation transmitted, for example, via an deflecting mirror 34 and another optical system, including an optical fiber and/or a system of mirrors to one or more optical consumer systems which uses broadband radiation emitted by plasma.

In the embodiments of the invention, the cap of the chamber is equipped with a heater, which consists of, for example, a heating coil 36, a current source 37, which is connected to the former through a temperature bridge 38 intended to provide a temperature difference between heating coil 36 and current busbars 39. Furthermore, current busbars 39 may be equipped with a heat exchanger (not shown), for example, in the form of air-cooled radiators. Cap 13 of the chamber may also be equipped with a thermocouple 40 to measure the chamber temperature. Besides, cap 13 of the chamber with heating coil 36 may be placed in a heat-insulating enclosure (not shown).

Heater 36 is intended for pre-start heating of the chamber up to an operating temperature, that facilitates the starting plasma ignition and ensures fast onset of the steady running mode of the light source with the preset optimally high temperature of the chamber, which is, preferably, in a range of 600 to 900 K.

In the preferred embodiment of the invention, the high-brightness light source contains a control unit 41, which incorporates the function of automated maintaining the preset power in beam 7 of plasma radiation directed to the consumer system, FIG. 5. For this purpose, the light source is equipped with a power meter 42, to which, using a coupler (not shown), a small part of the luminous flux from beam 7 of plasma radiation directed to the consumer system is supplied. Preferably, the control unit is connected with heater 35, thermocouple 40, power meter 42, pulsed laser system 9, and the power supply unit of CW laser 4. The preset power in beam 7 of plasma radiation is maintained by control unit 41 via a feedback circuit between power meter 42 and the power supply unit of CW laser 4. Besides, control unit 41 may incorporate the function of temperature stabilization of the chamber at an optimally high temperature. In this embodiment of the invention, high stability of power and brightness of the laser-pumped plasma light source is achieved.

Figure 6:
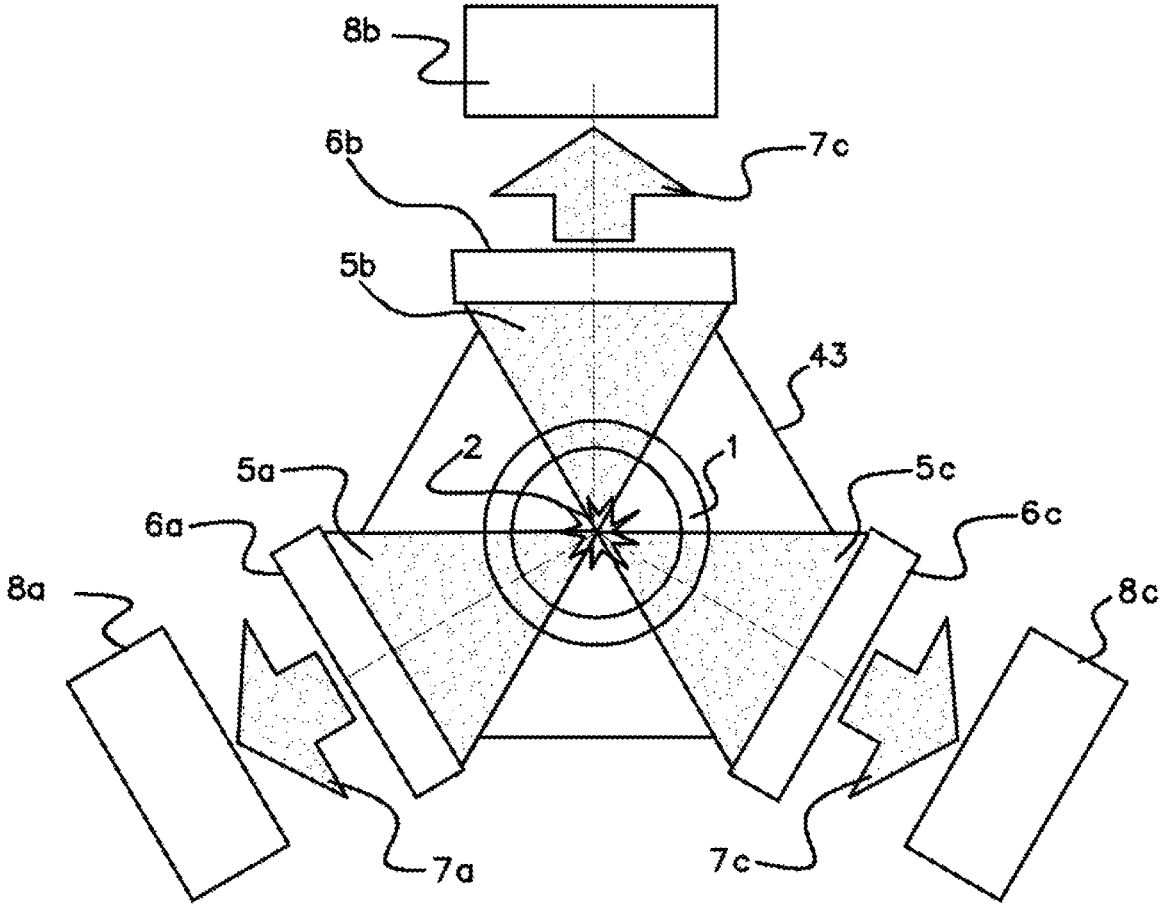

Along with the output of beam 5 of plasma radiation to optical collector 6 in all azimuths, the invention is not limited only to this embodiment. In another embodiment of invention, the light source can have at least three diverging output beams 5*a*, 5*b*, 5*c* of plasma radiation, as illustrated in FIG. 6, which shows the light source cross-section in the horizontal plane passing through radiating plasma region 2. The laser beams in FIG. 6, used for COD ignition and sustenance, are located below the drawing plane. The use of several, in particular, three beams of plasma radiation from one light source is required for a number of industrial applications. In this embodiment of the invention, chamber 1 of the laser-pumped plasma light source may be placed in a casing 43, which is equipped with three optical collectors 6*a*, 6*b*, 6*c*. Optical collectors 6*a*, 6*b*, 6*c* form the beams of plasma radiation 7*a*, 7*b*, 7*c* transmitted, for example, via an optical fiber to optical consumer systems 8*a*, 8*b*, 8*c*, which use broadband plasma radiation. This allows to use one light source for three or more optical consumer systems resulting in compact size of the system and identical parameters of broadband radiation in all optical channels.

Figure 7:
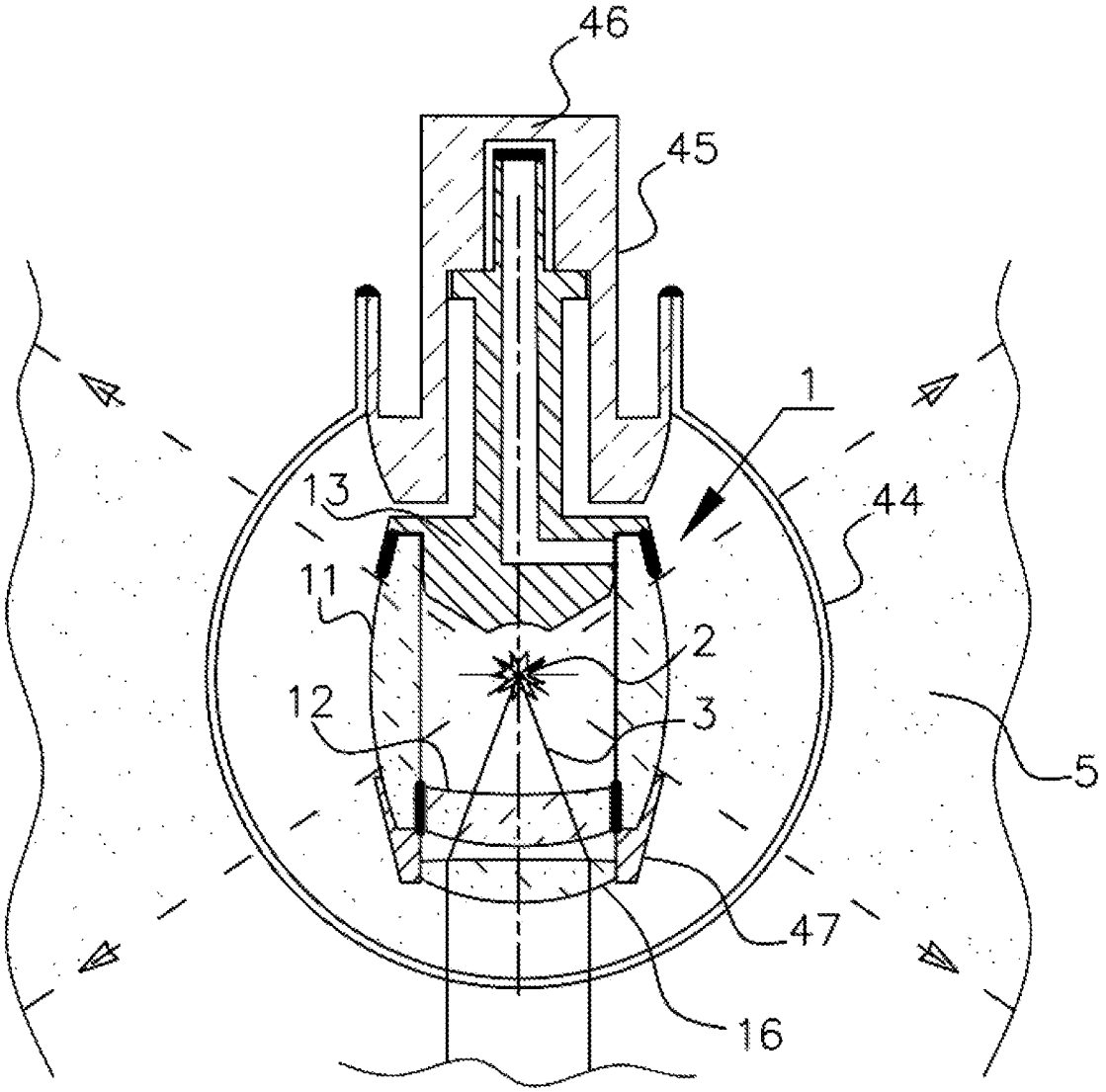

In another embodiment of the invention, shown in FIG. 7, the chamber 1 is placed into an external bulb 44 with a socket 45. The socket may be used to attach chamber 1 and may be partially filled with a sealing material 46. The sealed connections are shown in FIG. 7 in bold lines.

To minimize aberrations, the external bulb, preferably, has a spherical part with a center in radiating plasma region 2.

Focusing optical element 16, which, in particular case, is a lens, is, preferably, also placed into the external bulb. In this case, focusing lens 16 is fixed in a rim 47, which in its turn is fixed, for example, by means of glass cement or brazing on the near-end part of tube 11, FIG. 7.

In order to eliminate convective flows outside the chamber 1 and increase brightness stability of the light source, the external bulb is, preferably, evacuated.

In the embodiments of the invention, the external bulb may incorporate the function of filter cutting off the radiation with wavelengths below 240-260 mm, i. e. may be used in ozone-free modifications of the light source.

Generally, the proposed invention allows for creating long life time electrode-free high-brightness broadband light sources with highest spatial and power stability and capability of collecting plasma radiation in a solid angle exceeding 9 sr.

INDUSTRIAL APPLICABILITY

High-brightness high-stability laser-pumped plasma light sources designed according to the present invention can be used in a variety of projection systems, for spectrochemical analysis, spectral microanalysis of bio objects in biology and medicine, microcapillary liquid chromatography, for inspection of the optical lithography process, for spectrophotometry and for other purposes.

What is claimed is:

1. A laser-pumped plasma light source, comprising: a chamber filled with high-pressure gas, a region of radiating plasma sustained in the chamber by a focused beam of a continuous wave (CW) laser; at least one output beam of plasma radiation exiting the chamber, a means for plasma ignition, wherein the means for plasma ignition is a pulsed laser system generating at least one pulsed laser beam focused in the chamber;

the chamber consists of a tube, a bottom and a cap; one end of the tube is hermetically connected to the bottom, while the other end of the tube is hermetically connected to the cap;

the cap is arranged for filling the chamber with the gas;

the tube and the bottom of the chamber are made from an optically transparent material; the bottom is arranged for introducing the focused beam of the CW laser and each pulsed laser beam into the chamber, and the tube is arranged for exit of the output beam of plasma radiation from the chamber.

2. The light source according to claim 1, wherein a shape of the tube is configured for reducing aberrations which distort a path of the output beam of plasma radiation passing through a tube wall.

3. The light source according to claim 1, wherein at least a portion of the tube has an axis of symmetry, a center of symmetry and a barrel or a toroidal shape of an external surface, while the radiating plasma region is located at the center of symmetry of the tube.

4. The light source according to claim 1, wherein an internal surface of the tube is cylindrical.

5. The light source according to claim 4, wherein a radius of the internal surface of the tube is less than 5 mm, preferably not more than 3 mm.

6. The light source according to claim 1, wherein the tube, excluding its end parts, is configures for exit of the output beam of plasma radiation from the chamber in all azimuths.

7. The light source according to claim 1, wherein the output beam of plasma radiation exits the chamber in a solid angle of not less than 9 sr.

8. The light source according to claim 1, wherein the beam of the CW laser is focused in the chamber by means of an optical system comprising the chamber bottom and a focusing optical element with a surface minimizing total aberrations of the optical system.

9. The light source according to claim 8, wherein the focusing optical element is an aspherical lens.

10. The light source according to claim 1, wherein the focused beam of the CW laser is directed into the chamber vertically upwards.

11. The light source according to claim 1, wherein a part of the cap is designed as a concave spherical mirror with a center in the region of the radiating plasma region and a cap radius is less than 5 mm.

12. The light source according to claim 1, wherein the tube and the bottom are made from a material belonging to a group of sapphire, leuco sapphire, fused quartz, crystalline quartz.

13. The light source according to claim 1, wherein the tube and the bottom are sealed using a glass cement.

14. The light source according to claim 1, wherein the tube and the bottom are made as a whole from a single piece of material.

15. The light source according to claim 1, wherein the tube and the cap are sealed by means of brazing.

16. The light source according to claim 1, wherein the cap is equipped with a gas port arranged for controlling a pressure and a composition of the gas in the chamber.

17. The light source according to claim 1, wherein the cap is equipped with a heater.

18. The light source according to claim 1, wherein the means for plasma ignition is a solid-state laser system generating in Q-switching mode and in free-running mode two pulsed laser beams focused into the chamber.

19. The light source according to claim 1 with three or more output beams of plasma radiation.

20. The light source according to claim 1, wherein the chamber is located in an external bulb.

* * * * *